US007423509B2

(12) United States Patent
Orlando et al.

(10) Patent No.: US 7,423,509 B2
(45) Date of Patent: Sep. 9, 2008

(54) COIL COMPRISING SEVERAL COIL BRANCHES AND MICRO-INDUCTOR COMPRISING ONE OF THE COILS

(75) Inventors: Bastien Orlando, Les Pennes Mirabeau (FR); Bernard Viala, Sassenage (FR)

(73) Assignees: Commissariat A L'Energie Atomique, Paris (FR); Centre National de la Recherche Scientifique, Paris (FR); STMicroelectronics SA, Montrouge (FR)

( * ) Notice: Subject to any disclaimer, the term of this patent is extended or adjusted under 35 U.S.C. 154(b) by 0 days.

(21) Appl. No.: 11/907,217

(22) Filed: Oct. 10, 2007

(65) Prior Publication Data

US 2008/0094165 A1 Apr. 24, 2008

(30) Foreign Application Priority Data

Oct. 23, 2006 (FR) ..... 06 09274

(51) Int. Cl.
*H01F 5/00* (2006.01)
*H01F 27/29* (2006.01)

(52) U.S. Cl. ..... 336/200; 336/223; 336/232; 336/189; 336/190

(58) Field of Classification Search ..... 336/189, 336/190, 191, 200, 223, 232
See application file for complete search history.

(56) References Cited

U.S. PATENT DOCUMENTS

| | | | | |
|---|---|---|---|---|
| 2,709,791 | A | 5/1955 | Anderson | |
| 3,798,959 | A | 3/1974 | Astle et al. | |
| 4,810,989 | A * | 3/1989 | Brandenberg et al. | 336/84 M |
| 5,939,966 | A * | 8/1999 | Shin'Ei | 336/223 |
| 6,114,937 | A | 9/2000 | Burghartz et al. | |
| 6,147,584 | A * | 11/2000 | Shin'el | 336/223 |
| 6,367,143 | B1 * | 4/2002 | Sugimura | 29/602.1 |
| 6,380,727 | B1 * | 4/2002 | Jitaru | 324/117 R |
| 6,833,781 | B1 * | 12/2004 | Padmanabhan et al. | 336/200 |
| 7,194,799 | B2 * | 3/2007 | Liang et al. | 29/606 |
| 2007/0008058 | A1 | 1/2007 | Hashimoto | |

FOREIGN PATENT DOCUMENTS

| | | | |
|---|---|---|---|
| DE | 101 04 648 | A1 | 1/2002 |
| JP | 58137206 | A * | 8/1983 |

OTHER PUBLICATIONS

Von Der Weth et al., "Numerical Inductor Optimization", *Transactions of the Magnetics Society of Japan*, vol. 2, pp. 361-366, Dec. 1, 2002.

* cited by examiner

*Primary Examiner*—Anh T Mai
(74) *Attorney, Agent, or Firm*—Oliff & Berridge, PLC

(57) ABSTRACT

The coil comprises a plurality of non-joined turns, each turn comprising a rectangular bottom flat section in a bottom plane and a rectangular top flat section in a top plane and two rising sections. The turns fill almost all of the enveloping surface of the coil, a minimum isolating gap separating the adjacent turns. The top and bottom sections corresponding to one and the same turn are aligned with respect to one another and have a larger width than the width of the corresponding rising sections. The turns constitute a plurality of substantially parallel coil branches, rising sections of two adjacent branches arranged between the two adjacent branches being arranged alternately in a single plane.

6 Claims, 4 Drawing Sheets

COIL COMPRISING SEVERAL COIL BRANCHES AND MICRO-INDUCTOR COMPRISING ONE OF THE COILS

BACKGROUND OF THE INVENTION

The invention relates to a coil comprising a plurality of non-joined turns forming a plurality of substantially parallel coil branches, each turn comprising a rectangular bottom flat section in a bottom plane, a rectangular top flat section in a top plane and two rising sections, the rising sections of two adjacent branches arranged between the two adjacent branches being arranged alternately in a single plane.

STATE OF THE ART

The invention relates to the field of integrated micro-inductors for power electronics applications. It can, in a more general manner, apply to all inductive systems, either integrated or not (inductors, transformers, magnetic recording heads, actuators, sensors, etc . . . ) requiring a high electric power density.

Micro-inductors of various types have existed for a number of years. However, discrete components remain for the most part essentially used in applications using high power densities, as only this kind of component enable very thick coil wires to be used enabling very low electric resistance levels to be achieved. Most of the micro-inductors used on the market are discrete components manufactured by micro-mechanical methods of micro-machining, sticking, micro-winding, etc . . . . These methods are heavy to implement, require individual treatment, are far from flexible in terms of design, and greatly limit miniaturization of the power circuits. In particular, the thickness of the discrete micro-inductors (typically greater than 0.5 mm) does not enable the power supply circuits currently used for mobile telephony, for example, to be suitably incorporated in a chip.

The manufacturing techniques used in microelectronics provide a much greater flexibility as far as implementing different designs is concerned, enable collective treatment to be performed, and are compatible with the idea of miniaturization, as the thickness (substrate included) can easily be less than 300 μm. However, they are not suitable for depositions of large thicknesses (greater than 10 μm) of magnetic or dielectric conducting materials and for etching of these materials after photolithography.

For integrated components, technological manufacturing constraints constitute a limitation. Indeed, depositing conducting layers having a thickness of more than 100 micrometers is not for the moment envisageable in a standard industrial process.

Toroidal solenoid type micro-inductors present a good trade-off between inductance losses and level as they come close to the ideal case of the infinite solenoid.

The article "Numerical Inductor Optimization" by A. von der Weth et al. (Trans. Magn. Soc. Japan, Vol. 2, No. 5, pp. 361-366, 2002) describes a micro-inductor with an open magnetic circuit composed of a plurality of parallelepipedic cores. A plurality of turns not joined to one another forms a coil around the branches of the magnetic core. Each turn comprises a bottom flat section in a bottom plane, a top flat section in a top plane, and two rising flat sections. The rising sections of two adjacent branches arranged between the two adjacent branches are arranged alternately in a single plane, which enables a small spacing to be obtained between two adjacent branches, thereby enabling the compactness of the device to be increased. For these devices, it is sought to increase the inductance level and to minimize losses.

OBJECT OF THE INVENTION

The object of the invention consists in improving the performances of a micro-inductor while at the same time increasing the compactness of the micro-inductor.

According to the invention, this object is achieved by a coil according to the appended claims and more particularly by the fact that the top and bottom sections corresponding to one and the same turn being aligned with respect to one another and having a larger width than the width of the corresponding rising sections arranged between two adjacent coil branches, the turns fill almost all of the enveloping surface of the coil, a minimum isolating gap separating the adjacent turns.

BRIEF DESCRIPTION OF THE DRAWINGS

Other advantages and features will become more clearly apparent from the following description of particular embodiments of the invention given for non-restrictive example purposes only and represented in the accompanying drawings, in which.

DESCRIPTION OF A PREFERRED EMBODIMENT OF THE INVENTION

The different types of coils described above can be achieved without necessarily using a magnetic core. Preferably however, the coil envelops a magnetic core.

Figure 1:
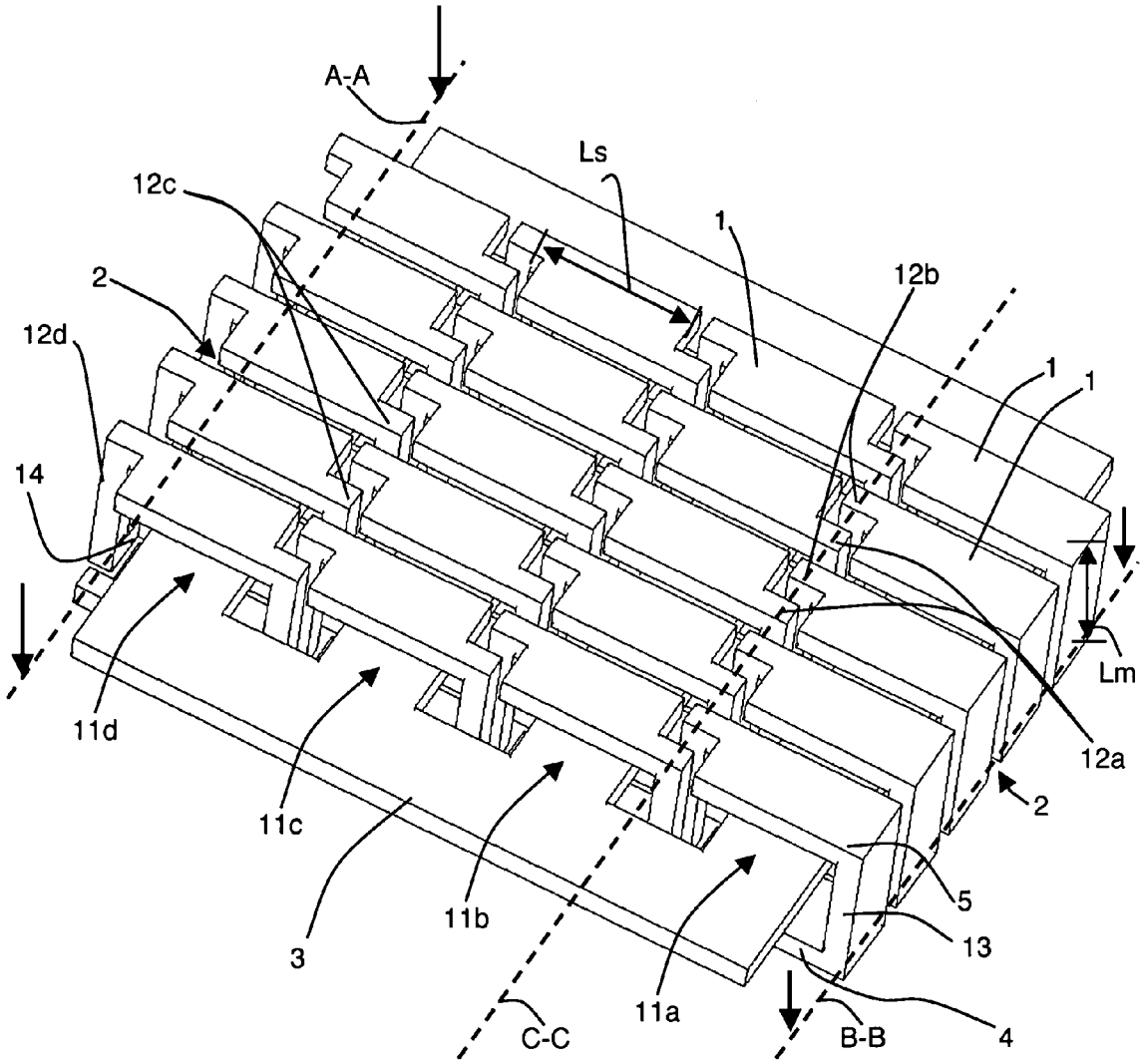
FIGS. 1 to 3 represent a particular embodiment of the invention, respectively in perspective view, in top view and in cross-section seen from below in the plane defined by the two lines A-A and B-B of FIG. 2.
Figure 2:
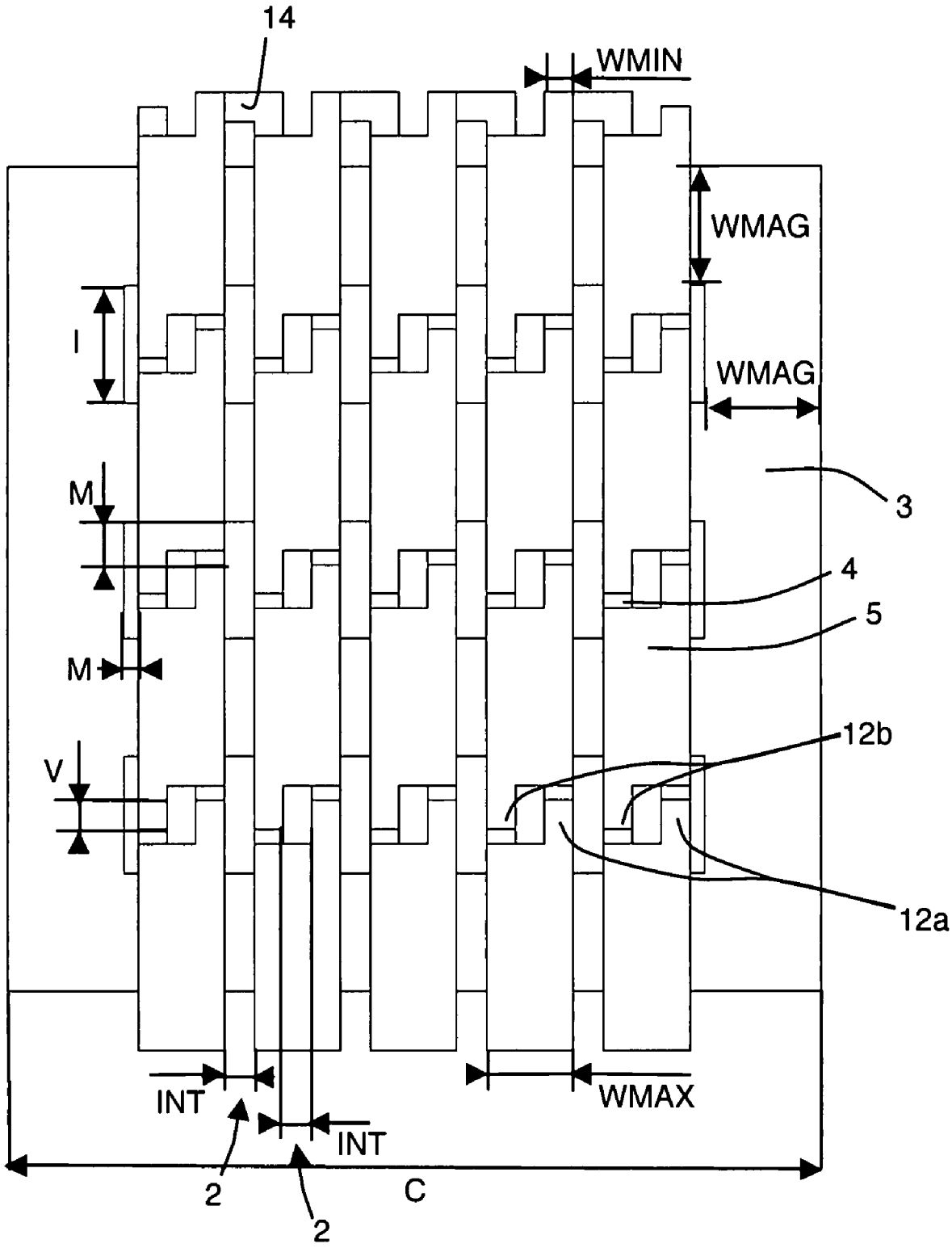
Figure 3:
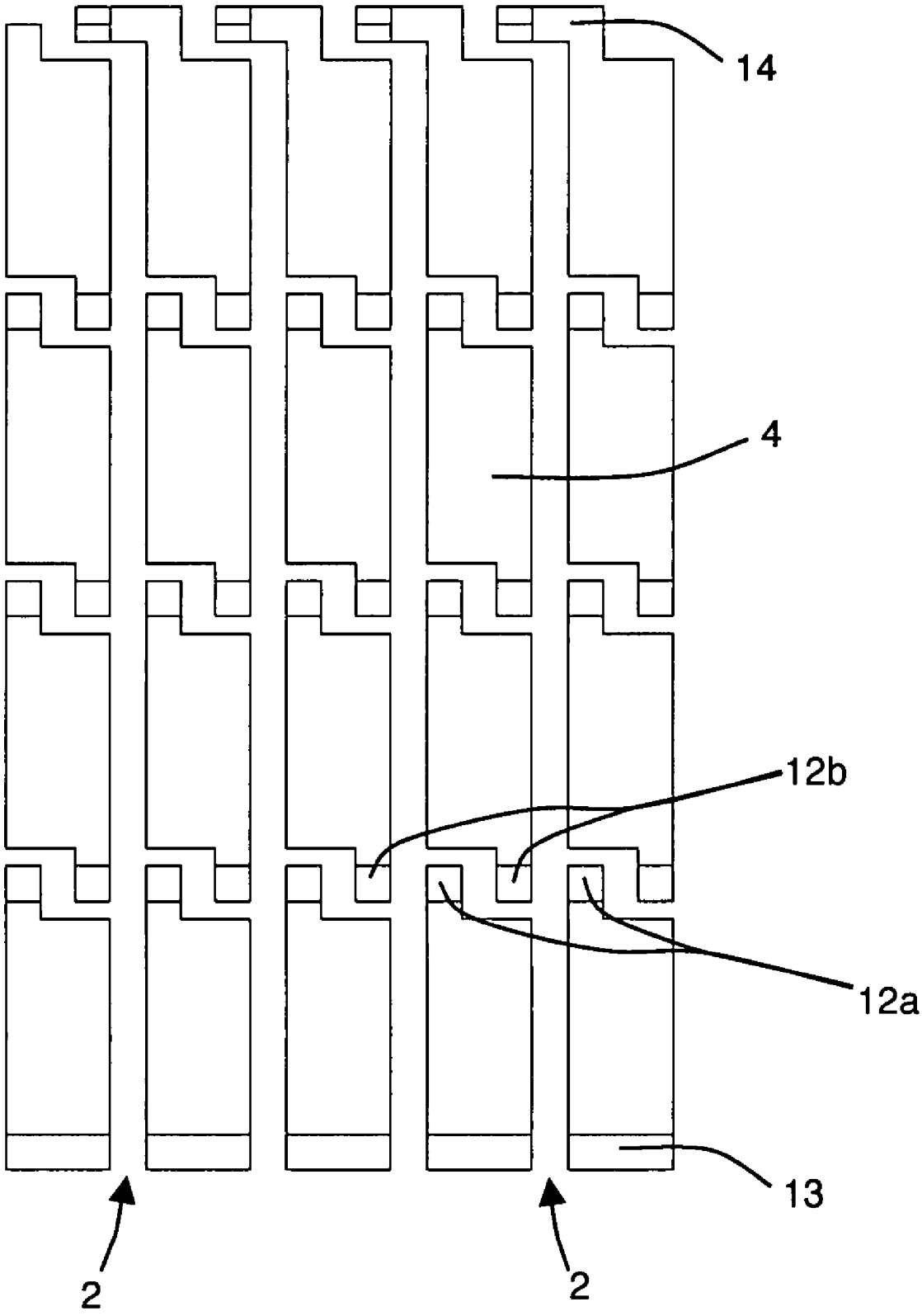

The coil represented in FIGS. 1 to 3 comprises a plurality of turns 1 separated from one another by a minimum isolating gap 2 separating the adjacent turns 1. The isolating gap 2 is fixed by technological production constraints and the required electromagnetic behavior. The turns 1 form a coil around a magnetic core 3 comprising four parallel branches 11 (11*a*, 11*b*, 11*c*, 11*d*). The same coil could also be envisaged without a magnetic core or with an open core. The plurality of non-joined turns 1 form a coil around the substantially parallel branches 11 of the magnetic core 3. When this coil is used without a magnetic core, the non-joined turns 1 form a plurality of substantially parallel coil branches.

Each turn 1 comprises a bottom flat section 4 in a bottom plane, a top flat section 5 in a top plane and two rising flat sections 12 and 13. It should be noted that these four elements (the bottom flat section 4, the top flat section 5 and the two rising flat sections 12 and 13) are not joined to one another so as to form a loop, as for example in the case of a conventional solenoid coil. The flat sections 4 and 5 can in fact belong to distinct electrical conductors, each electrical conductor going from the bottom plane for a predetermined branch to the top plane for an adjacent branch and vice-versa. The turns 1 fill almost all of the enveloping surface of the coil, except for the minimum isolating gap 2.

What is meant by enveloping surface of the coil is a continuous surface delineated by the coil and joining the adjacent turns to one another. The enveloping surface of the coil thus includes the turns 1 and the isolating gaps 2. This enveloping surface of the coil has to be filled as far as possible by the turns 1, the isolating gap 2 only serving the purpose of performing electrical isolation between the turns 1. The isolating gaps 2 can moreover be filled with an insulating material.

Thus in FIG. 1, the turns constitute an almost complete envelope of the branches of the magnetic core 3. Unlike devices of the prior art, the micro-inductor uses all the space potentially available for the coil and does not leave any unused space. The micro-inductor thus has a lower resistance for predetermined overall dimensions.

The thickness of the coil is a trade-off between the ease of production and the required resistance level.

The rising sections 12*a* and 12*b* of two adjacent branches 11*a* and 11*b* arranged between the two adjacent branches 11*a* and 11*b* are arranged alternately (12*a*, 12*b*, 12*a*, 12*b*, . . . ) in a single plane. In the particular embodiment represented in FIG. 1, this single plane is perpendicular to the plane of the magnetic core 3 and passes via the line C-C which passes via the rising sections 12*a* and 12*b*. The turns 1 form an almost complete envelope of the branches 11 of the magnetic core, a minimum isolating gap 2 separating the adjacent turns 1.

The turns 1 thus fill almost all the enveloping surface of the coil, the coil being formed by several coil branches, with or without a magnetic core.

On account of their dimensions, the top 5 and bottom 4 sections represent most of the surface of the turns. Thus, whereas the length Lm (FIG. 1) of the rising sections 12 is for example about 20 microns, the length Ls of the bottom 4 and top 5 sections is for example about a few hundred microns. The top 5 and bottom 4 sections preferably have a substantially rectangular shape (see FIGS. 1 to 4), to which connections to the rising sections 12 are added. The top section 5 advantageously has the same dimensions and preferably the same shape as the bottom section 4 corresponding to the same turn 1, and they are preferably aligned with respect to one another. In this way they are completely superposed on one another, i.e. their projections in a plane parallel to the top 5 and bottom 4 sections are the same.

In FIGS. 1 to 3, the top 5 and bottom 4 sections have a larger width than the width of the corresponding rising sections 12*a* and 12*b* arranged between two adjacent branches 11*a* and 11*b*. The width of the rising sections 12*a* and 12*b* arranged between two adjacent branches 11*a* and 11*b* is preferably smaller than half of the width of the top 5 and bottom 4 sections to enable the turns to be entangled at the level of the crossings between the turns. The top 5 and bottom 4 sections therefore have a larger width than the sum of the widths of the corresponding rising sections 12 arranged between two adjacent coil branches. Advantageously the rising sections 12*a* and 12*b* have the same surface.

The rising sections 13 arranged outside an external branch 11*a* of the micro-inductor can present the same width as the top 5 and bottom 4 sections of the corresponding turns 1 of the same branch 11*a*.

In FIGS. 1 to 3, the top 5 and bottom 4 sections of each turn 1 corresponding to the branch 11*a* (on the right of FIG. 1) are joined by the rising sections 13 arranged on the outside. The top 5 and bottom 4 sections of each turn 1 corresponding to the branch 11*d* at the other end of the core 3 (on the left of FIG. 1) are joined by the rising sections 12*c* arranged between the adjacent branches 11*c* and 11*d*. Two adjacent turns corresponding to the branch 11*d* at the end of the core 3 (represented on the left of FIG. 1) are joined by a rising section 12*d* arranged on the outside and a connecting section 14 arranged in the bottom plane corresponding to the bottom sections 4.

Dimensioning of this coil can be performed in the following manner illustrated in FIG. 2. The length C of the magnetic core is defined. All the branches of the core will be considered to have the same width WMAG. The technological and electrical constraints fix the dimensions V of the rising sections 12, the distance between turns INT and the separating distance M between the coil and the magnetic circuit. It should be noted that FIG. 2 is not to scale and that the distance M is therefore variable in FIG. 2. The distance between two adjacent turns INT corresponds to the minimum isolating gap 2. The distance between the branches I must be at least I=V+2*M. The coil can then be completely defined. The number of turns per branch N (five in FIG. 2) is determined by the required inductance level. The width WMAX of the top 5 and bottom 4 sections is calculated by means of the formula WMAX=(C−2*WMAG−(N−1)*INT−2M)/N. The width WMIN of the rising sections 12 is calculated by means of the formula WMIN=(WMAX−INT)/2. The thickness of conducting material is finally fixed as a trade-off between ease of production and the required resistance level.

Figure 4:
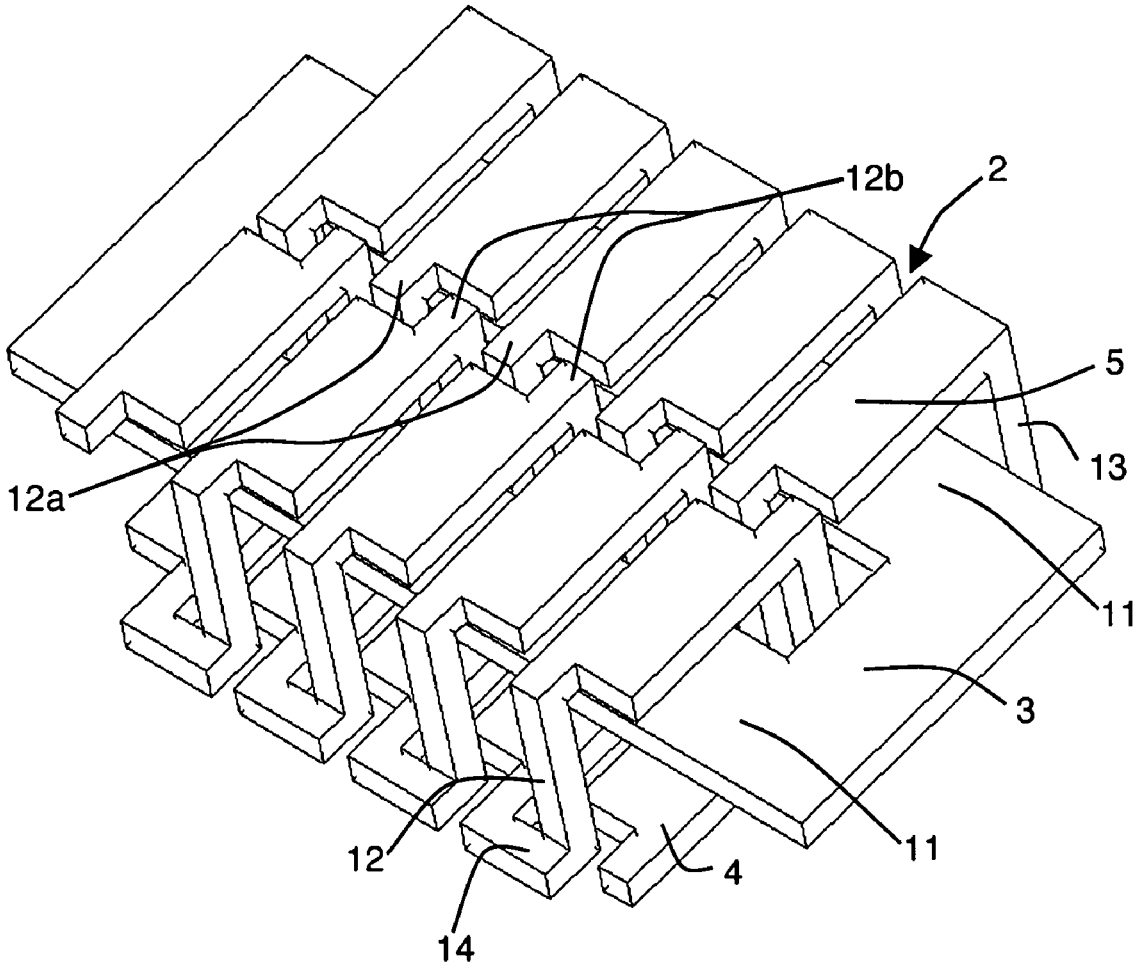
FIG. 4 represents another particular embodiment of the invention, in perspective view.

A micro-inductor with a substantially annular closed magnetic core 3 only two parallel branches 11 whereof are covered by a coil forming an almost total envelope of the two branches 11 is illustrated in FIG. 4. The same type of coil as the one described above can be used.

The particular embodiment enables the performances of inductive systems to be improved and in particular enables the inductance of the micro-inductor and the compactness of the coil to be increased.

In the particular embodiment described, the turns form an almost complete envelope of the magnetic core over the whole of the parallel branches of the multi-branch core. Only the minimum isolating gaps 2 separate the bottom flat sections 4 of two adjacent turns, the top flat sections 5 of two adjacent turns and two adjacent rising sections. The minimum isolating gap 2 depends on the manufacturing technology used and on the electromagnetic constraints. The gap between turns does not exceed the minimum isolating gap 2.

For integrated components using conventional microfabrication techniques, the two alternative embodiments do not present any additional fabrication difficulties compared with already existing conventional systems. For example, the top 5 and bottom 4 sections can respectively be etched in conducting layers.

We claim:

1. A coil comprising a plurality of non-joined turns forming a plurality of substantially parallel coil branches, each turn comprising a rectangular bottom flat section in a bottom plane, a rectangular top flat section in a top plane and two rising sections, the rising sections of two adjacent branches arranged between the two adjacent branches being arranged alternately in a single plane, wherein the top and bottom sections corresponding to one and the same turn being aligned with respect to one another and having a larger width than the width of the corresponding rising sections arranged between two adjacent coil branches, the turns fill almost all of the enveloping surface of the coil, a minimum isolating gap separating the adjacent turns.

2. The coil according to claim 1, wherein the top and bottom sections corresponding to one and the same turn have the same shape.

3. The coil according to claim 1, wherein the top and bottom sections have a larger width than the sum of the widths of the corresponding rising sections arranged between two adjacent coil branches.

4. The coil according to claim 1, wherein the rising sections arranged outside an external branch of the coil present the same width as the top and bottom sections of the corresponding turns.

5. A micro-inductor, comprising a coil according to claim 1.

6. The micro-inductor according to claim 5, comprising a magnetic core enveloped by the coil.

* * * * *